US008893904B2

(12) United States Patent
Qi et al.

(10) Patent No.: US 8,893,904 B2
(45) Date of Patent: Nov. 25, 2014

(54) CRANE WITH AUTOMATIC COUNTERWEIGHT BALANCING DEVICE AND METHOD OF ARRANGING COUNTERWEIGHT THEREOF

(71) Applicant: Shenzhen China Star Optoelectronics Technology Co., Ltd., Shenzhen (CN)

(72) Inventors: Minghu Qi, Shenzhen (CN); Chunhao Wu, Shenzhen (CN); Kunhsien Lin, Shenzhen (CN); Yongqiang Wang, Shenzhen (CN); Zhenhua Guo, Shenzhen (CN); Weibing Yang, Shenzhen (CN); Zenghong Chen, Shenzhen (CN); Yunshao Jiang, Shenzhen (CN); Zhiyou Shu, Shenzhen (CN)

(73) Assignee: Shenzhen China Star Optoelectronics Technology Co., Ltd., Shenzhen, Guangdong Province (CN)

( * ) Notice: Subject to any disclaimer, the term of this patent is extended or adjusted under 35 U.S.C. 154(b) by 173 days.

(21) Appl. No.: 13/703,900

(22) PCT Filed: Oct. 10, 2012

(86) PCT No.: PCT/CN2012/082659

§ 371 (c)(1),
(2), (4) Date: Dec. 12, 2012

(87) PCT Pub. No.: WO2014/040328

PCT Pub. Date: Mar. 20, 2014

(65) Prior Publication Data

US 2014/0076836 A1 Mar. 20, 2014

(30) Foreign Application Priority Data

Sep. 14, 2012 (CN) ..... 2012 1 0341612

(51) Int. Cl.
*B66C 13/18* (2006.01)
*B66C 13/00* (2006.01)

(52) U.S. Cl.
CPC ..... *B66C 13/18* (2013.01); *B66C 13/00* (2013.01)
USPC ..... 212/279; 212/197

(58) Field of Classification Search
CPC ..... B66C 23/74; B66C 23/72; B66C 23/78; B66C 13/18
USPC ..... 212/278, 279, 197
See application file for complete search history.

(56) References Cited

U.S. PATENT DOCUMENTS

2012/0111670 A1* 5/2012 Fargo et al. ..... 187/247
2013/0239491 A1* 9/2013 Tadayon ..... 52/123.1

FOREIGN PATENT DOCUMENTS

CN 101293624 A 10/2008
CN 201415881 Y 3/2010
CN 102060226 A 5/2011
JP 2008-37595 A 2/2008

* cited by examiner

*Primary Examiner* — Emmanuel M Marcelo
(74) *Attorney, Agent, or Firm* — Cheng-Ju Chiang

(57) ABSTRACT

The present invention provides a crane with an automatic counterweight balancing device and a method of arranging counterweight thereof. The crane includes a main body and a counterweight device mounted to the main body. The counterweight device includes first and second magnetic field generators and first and second permanent magnetic counterweight blocks. The crane uses a combined arrangement of the magnetic field generators, the permanent magnetic counterweight blocks, an electrical control device, and a transducer device to detect, in a real time manner, output torques of servo motors, whereby when the output torques are not equal to rating torques, magnetic field intensities are varied to change downward magnetic forces acting on the permanent magnetic counterweight blocks thereby regulating loading of the servo motors and thus regulating the output torques of the servo motors to effect automatic balancing of counterweight and improve stability of the crane during a conveyance process.

9 Claims, 3 Drawing Sheets

CRANE WITH AUTOMATIC COUNTERWEIGHT BALANCING DEVICE AND METHOD OF ARRANGING COUNTERWEIGHT THEREOF

BACKGROUND OF THE INVENTION

1. Field of the Invention

The present invention relates to a crane, and in particular to a pin structure of a crane with an automatic counterweight balancing device and a method of arranging counterweight thereof.

2. The Related Arts

Liquid crystal display (LCD) has a variety of advantages, such as thin device body, low power consumption, and being free of radiation, and is thus widely used. Most of the LCDs that are currently available in the market are backlighting LCDs, which comprise a liquid crystal display panel and a backlight module. The operation principle of the liquid crystal display panel is that liquid crystal polymer molecules are interposed between two parallel glass substrates and the liquid crystal molecules are controlled to change direction by application of electricity to the glass substrates in order to refract out light emitting from the backlight module for generating images.

A liquid crystal display panel is generally composed of an upper substrate (CF, Color Filter), a lower substrate (TFT, Thin Film Transistor), and liquid crystal (LC) interposed between the upper substrate and the lower substrate, and a sealant. A general manufacturing process comprises a front stage of array process (including thin film, yellow light, etching, and film stripping), an intermediate stage of cell process (including bonding TFT substrate and the CF substrate), and a rear stage of assembling process (including mounting drive ICs and printed circuit board). The front stage of array process generally makes the TFT substrate for controlling the movement of liquid crystal molecules. The intermediate stage of cell process generally introduces liquid crystal between the TFT substrate and the CF substrate. The rear stage of assembling process generally mounts the drive ICs and combining the printed circuit board to effect driving the liquid crystal molecules to rotate for displaying images.

In the manufacturing process and warehousing of the liquid crystal display panel, the liquid crystal display panel is conveyed very often. To save the time of conveyance, the conventional way of conveying the liquid crystal display panel is generally carried out with a crane (as shown in FIG. 1) in order to realize conveyance of cassette (CST). In other words, a carriage platform 100 of a crane is loaded with cassettes of liquid crystal display panel 300 stacked thereon. Generally, a cassette of liquid crystal display panel 300 is of a weight of 2 tons. Motors 500 for Z-axis of the crane must carry quite a load. This may shorten the lifespan of the crane and thus increases the manufacturing cost.

To cope with the above problem, those skilled in the related art attempts to reduce the loading of the motors in the Z-axis of the crane by adopting a solution of increasing the counterweight of the crane. However, the counterweight is only used to balance the weight of Z-axis mechanisms. When cassettes are loaded on the carriage platform, the motors of the Z-axis are also carrying a great load and thus, the above descried issue cannot be well dissolved.

SUMMARY OF THE INVENTION

An object of the present invention is to provide a crane with an automatic counterweight balancing device, which has a simple structure and can effectively extend the operation life of servo motors so as to lower down costs.

Another object of the present invention is to provide a method of arranging counterweight, which utilizes coordination between a magnetic field generator and permanent magnet weight blocks to regulate output torque of servo motor so as to extend the operation life of the servo motor.

To achieve the objects, the present invention provides a crane with an automatic counterweight balancing device, which comprises a main body and a counterweight device mounted on the main body. The main body comprises first and second racks that are arranged opposite to each other, first and second transmission devices that are respectively mounted to the first and second racks, and a carriage platform connected between the first and second transmission devices. The counterweight device comprises first and second magnetic field generators respectively mounted to the first and second racks and first and second permanent magnetic counterweight blocks respectively mounted to the first and second transmission devices.

The first transmission device comprises a first pulley, a first transmission belt that is provided in association with the first pulley, and a first servo motor that is in driving coupling with the first pulley. The second transmission device comprises a second pulley, a second transmission belt that is provided in association with the second pulley, and a second servo motor that is in driving coupling with the second pulley.

The first permanent magnetic counterweight block is mounted to the first transmission belt. The second permanent magnetic counterweight block is mounted to the second transmission belt.

The counterweight device comprises an electrical control device electrically connected to the first and second magnetic field generators. The electrical control device functions to control magnetic field intensities of the first and second magnetic field generators.

The counterweight device comprises a transducer device electrically connected to the electrical control device. The transducer device functions to monitor output torques of the first and second servo motors and transmits the detected output torques to the electrical control device.

The permanent magnetic counterweight blocks comprise permanent magnets.

The present invention also provides a crane with an automatic counterweight balancing device, which comprises a main body and a counterweight device mounted on the main body, the main body comprising first and second racks that are arranged opposite to each other, first and second transmission devices that are respectively mounted to the first and second racks, and a carriage platform connected between the first and second transmission devices, the counterweight device comprising first and second magnetic field generators respectively mounted to the first and second racks and first and second permanent magnetic counterweight blocks respectively mounted to the first and second transmission devices;

wherein the first transmission device comprises a first pulley, a first transmission belt that is provided in association with the first pulley, and a first servo motor that is in driving coupling with the first pulley, the second transmission device comprising a second pulley, a second transmission belt that is provided in association with the second pulley, and a second servo motor that is in driving coupling with the second pulley;

wherein the first permanent magnetic counterweight block is mounted to the first transmission belt, the second permanent magnetic counterweight block being mounted to the second transmission belt;

wherein the counterweight device comprises an electrical control device electrically connected to the first and second magnetic field generators, the electrical control device functioning to control magnetic field intensities of the first and second magnetic field generators;

wherein the counterweight device comprises a transducer device electrically connected to the electrical control device, the transducer device functioning to monitor output torques of the first and second servo motors and transmitting the detected output torques to the electrical control device; and wherein the permanent magnetic counterweight blocks comprise permanent magnets.

The present invention further provides a method of assembling a crane, which comprises the following steps:

(1) providing a crane main body and a counterweight device, wherein the crane main body comprises first and second racks that are arranged opposite to each other, first and second transmission devices that are respectively mounted to the first and second racks, and a carriage platform connected between the first and second transmission devices, the first transmission device comprising a first pulley, a first transmission belt that is provided in association with the first pulley, and a first servo motor that is in driving coupling with the first pulley, the second transmission device comprising a second pulley, a second transmission belt that is provided in association with the second pulley, and a second servo motor that is in driving coupling with the second pulley, the counterweight device comprising first and second magnetic field generators, first and second permanent magnetic counterweight blocks, an electrical control device, and a transducer device;

(2) mounting the counterweight device to the crane main body, wherein the first magnetic field generators are mounted to two ends of the first rack, the first permanent magnetic counterweight block being mounted to the first transmission belt, the second magnetic field generators being mounted to two ends of the second rack, the second permanent magnetic counterweight block being mounted to the second transmission belt, the electrical control device being electrically connected to the first and second magnetic field generators, the transducer device being mounted to the first and second servo motors and electrically connected to the electrical control device;

(3) the transducer device monitoring, in a real time manner, output torques of the first and second servo motors and transmitting the detected output torques to the electrical control device, the electrical control device comparing the output torques of the first and second servo motors with rating torques of the first and second servo motors that are previously loaded in the electrical control device;

(4) the electrical control device controlling the first and second magnetic field generators to increase magnetic field intensities when the output torques of the first and second servo motors are greater than corresponding rating torques of the first and second servo motors, the first and second permanent magnetic counterweight blocks being subjected to an increased downward magnetic force thereby decreasing loading of the first and second servo motors, the output torques of the first and second servo motors being decreased with the decrease of the loading until the output torques are equal to the rating torques of the first and second servo motors; and (5) the electrical control device controlling the first and second magnetic field generators to decrease magnetic field intensities when the output torques of the first and second servo motors are less than the corresponding rating torques of the first and second servo motors, the first and second permanent magnetic counterweight blocks being subjected to a decreased downward magnetic force thereby increasing loading of the first and second servo motors, the output torques of the first and second servo motors being increased with the increase of the loading until the output torques are equal to the rating torques of the first and second servo motors.

The permanent magnetic counterweight blocks comprise permanent magnets.

The efficacy of the present invention is that the present invention provides a crane with an automatic counterweight balancing device and a method of arranging counterweight thereof, which uses a combined arrangement of magnetic field generators, permanent magnetic counterweight blocks, an electrical control device, and a transducer device to detect, in a real time manner, output torques of servo motors, whereby when the output torques are not equal to rating torques, magnetic field intensities are varied to change downward magnetic forces acting on the permanent magnetic counterweight blocks thereby regulating loading of the servo motors and thus regulating the output torques of the servo motors to effect automatic balancing of counterweight and improve stability of the crane during a conveyance process and also to effectively prevent over-loaded operation of the servo motors, extend the operation lives of the servo motors, and lower down the costs.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, will be apparent from the following detailed description of an embodiment of the present invention, with reference to the attached drawing. In the drawing.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
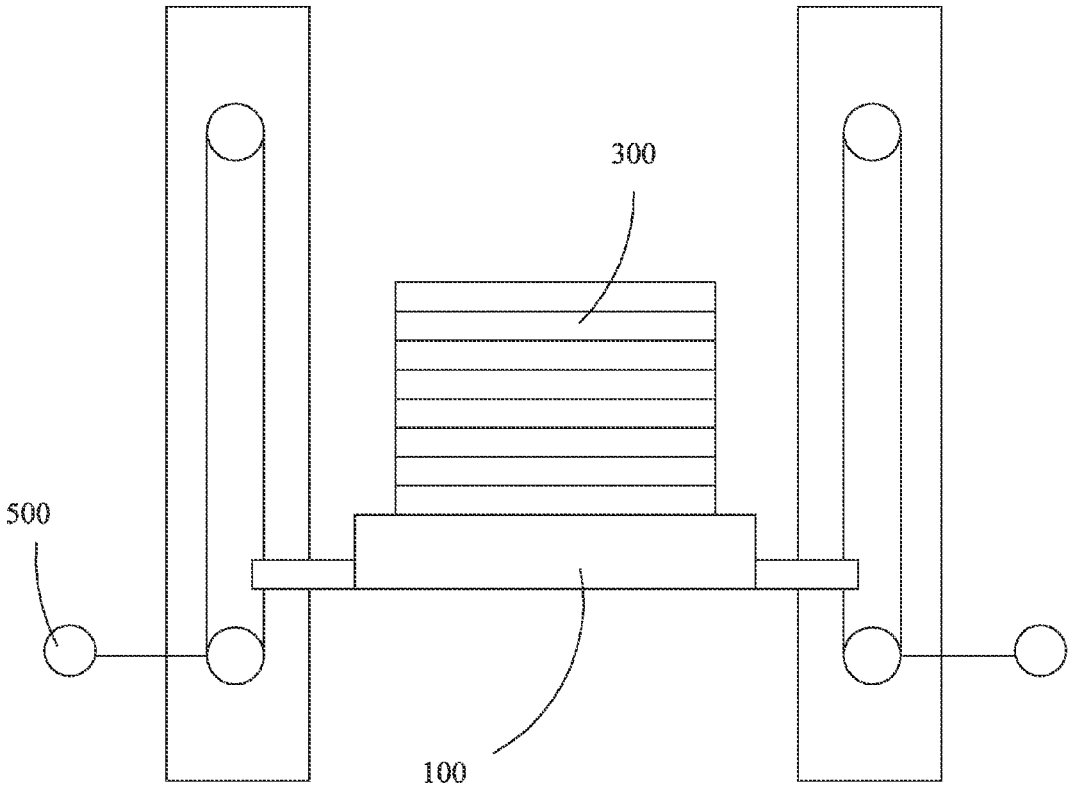
Fig. 1 (Prior Art)
FIG. 1 is schematic view showing the structure of a conventional crane.
Figure 2:
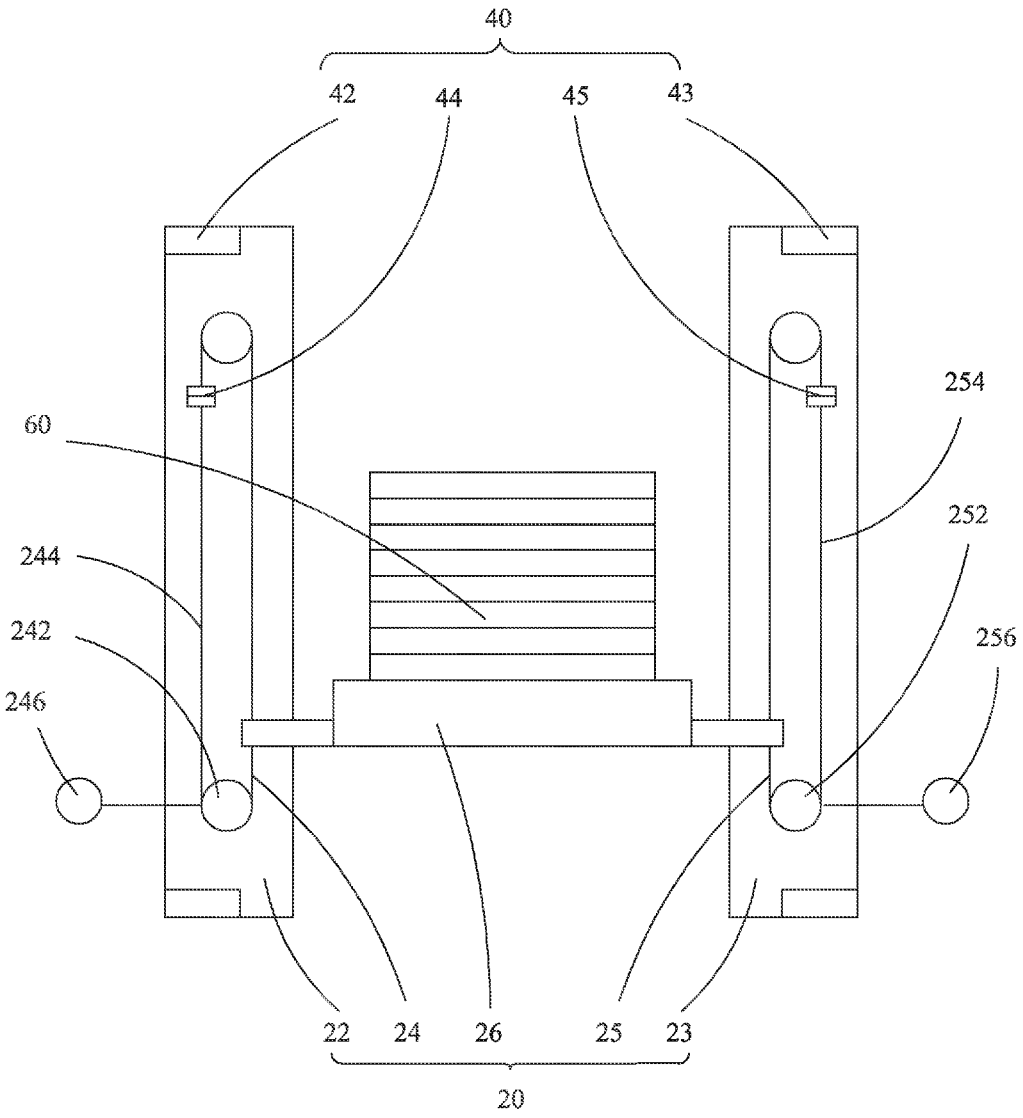
FIG. 2 is a schematic view showing the structure of a crane with an automatic counterweight balancing device according to the present invention.

Referring to FIG. 2, the present invention provides a crane with an automatic counterweight balancing device, which comprises a main body 20 and a counterweight device 40 mounted on the main body 20.

The main body 20 comprises first and second racks 22, 23 that are arranged opposite to each other, first and second transmission devices 24, 25 that are respectively mounted to the first and second racks 22, 23, and a carriage platform 26 connected between the first and second transmission devices 24, 25.

The first transmission device 24 comprises a first pulley 242, a first transmission belt 244 that is provided in association with the first pulley 242, and a first servo motor 246 that is in driving coupling with the first pulley 242. The second transmission device 25 comprises a second pulley 252, a second transmission belt 254 that is provided in association with the second pulley 252, and a second servo motor 256 that is in driving coupling with the second pulley 252.

The counterweight device 40 comprises first magnetic field generators 42 mounted to the first rack 22, a first permanent magnetic counterweight block 44 mounted to the first transmission device 24, second magnetic field generators 43 mounted to the second rack 23, and a second permanent magnetic counterweight block 45 mounted to the second transmission device 25. In the instant embodiment, the first and second permanent magnetic counterweight blocks 44, 45 are permanent magnets.

In the instant embodiment, the first permanent magnetic counterweight block 44 is mounted to the first transmission belt 244 and the second permanent magnetic counterweight block 45 is mounted to the second transmission belt 254.

The counterweight device 40 further comprises an electrical control device (not shown) that is electrically connected to the first and second magnetic field generators 42, 43. The electrical control device functions to control magnetic field intensities of the first and second magnetic field generators 42, 43.

The counterweight device 40 further comprises a transducer device (not shown) that is electrically connected to the electrical control device. The transducer device functions to monitor output torques of the first and second servo motors 246, 256 and transmit the detected output torques to the electrical control device.

In operation, liquid crystal panels 60 in the form of cassettes are positioned on the carriage platform 26. The first servo motor 246 drives the first pulley 242 to rotate. The first pulley 242 drives the first transmission belt 244 to move upward. Simultaneously, the second servo motor 256 drives the second pulley 252 to rotate and the second pulley 252 drives the second transmission belt 254 to move upward. The first and second transmission belts 244, 254 drive the carriage platform 26 to move upward. The transducer device monitors, in a real time manner, the output torques of the first and second servo motors 246, 256 and transmits the output torques of the first and second servo motors 246, 256 to the electrical control device. The electrical control device compares the output torques of the first and second servo motors 246, 256 with rating torques of the first and second servo motors 246, 256 that are established previously. When the output torques of the first and second servo motors 246, 256 are greater than the rating torques of the first and second servo motors 246, 256, the electrical control device controls the first and second magnetic field generators 42, 43 to increase the magnetic field intensity so that the first and second permanent magnetic counterweight blocks 44, 45 are subjected to an increased downward magnetic force thereby decreasing the loading of the first and second servo motors 246, 256. The output torques of the first and second servo motors 246, 256 are decreased with the decrease of loading until the output torques are equal to the rating torques of the first and second servo motors 246, 256. When the output torques of the first and second servo motors 246, 256 are less than the rating torques of the first and second servo motors 246, 256, the electrical control device controls the first and second magnetic field generators 42, 43 to decrease the magnetic field intensities so that the first and second permanent magnetic counterweight blocks 44, 45 are subjected to a decreased downward magnetic force thereby increasing the loading of the first and second servo motors 246, 256. The output torques of the first and second servo motors 246, 256 are increased with the increase of loading until the output torques are equal to the rating torques of the first and second servo motors 246, 256.

Figure 3:
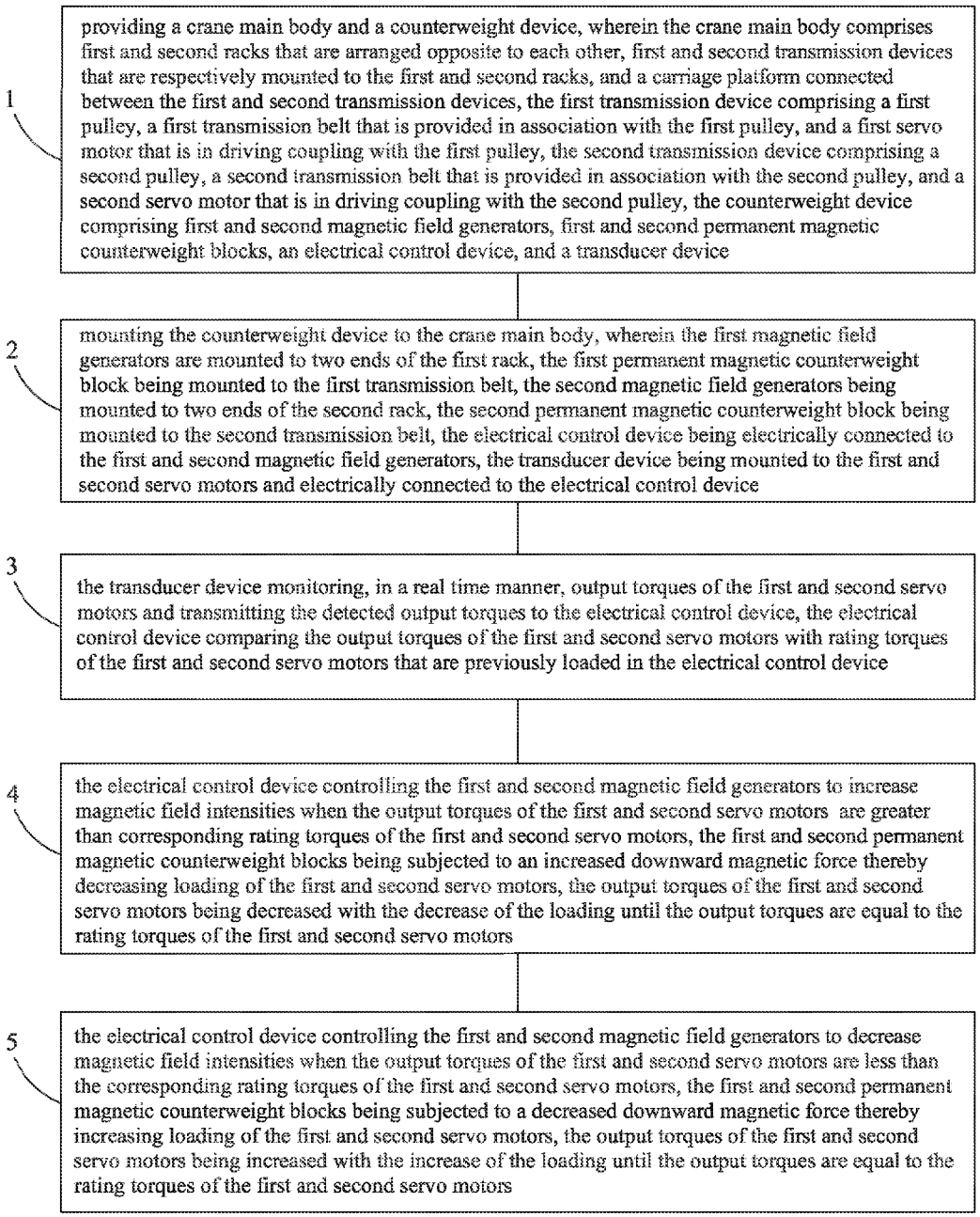
FIG. 3 is a flow chart illustrating a method of arranging counterweight of crane according to the present invention.

Referring to FIGS. 2 and 3, the present invention also provides a method of arranging counterweight of crane, which comprises the following steps:

Step 1: providing a crane main body 20 and a counterweight device 40, wherein the crane main body 20 comprises first and second racks 22, 23 that are arranged opposite to each other, first and second transmission devices 24, 25 that are respectively mounted to the first and second racks 22, 23, and a carriage platform 26 connected between the first and second transmission devices 24, 25, the first transmission device 24 comprising a first pulley 242, a first transmission belt 244 that is provided in association with the first pulley 242, and a first servo motor 246 that is in driving coupling with the first pulley 242, the second transmission device 25 comprising a second pulley 252, a second transmission belt 254 that is provided in association with the second pulley 252, and a second servo motor 256 that is in driving coupling with the second pulley 252, the counterweight device 40 comprising first and second magnetic field generators 42, 43, first and second permanent magnetic counterweight blocks 44, 45, an electrical control device (not shown), and a transducer device (not shown). In the instant embodiment, the first and second permanent magnetic counterweight blocks 44, 45 are permanent magnets.

Step 2: mounting the counterweight device 40 to the crane main body, wherein the first and second magnetic field generators 42, 43 are respectively mounted to two ends of the racks 22, 23, the first and second permanent magnetic counterweight blocks 44, 45 are mounted to the first and second transmission belts 242, 252, the electrical control device is electrically connected to the first and second magnetic field generators 42, 43, and the transducer device is mounted to the first and second servo motors 246, 256 and is electrically connected to the electrical control device.

Step 3: the transducer device monitoring, in a real time manner, output torques of the first and second servo motors 246, 256 and transmitting the detected output torques to the electrical control device, the electrical control device comparing the output torques of the first and second servo motors 246, 256 with rating torques of the first and second servo motors 246, 256 that are previously loaded in the electrical control device.

Step 4: the electrical control device controlling the first and second magnetic field generators 42, 43 to increase magnetic field intensities when the output torques of the first and second servo motors 246, 256 are greater than corresponding rating torques of the first and second servo motors 264, 256, the first and second permanent magnetic counterweight blocks 44, 45 being subjected to an increased downward magnetic force thereby decreasing loading of the first and second servo motors 246, 256, the output torques of the first and second servo motors 246, 256 being decreased with the decrease of the loading until the output torques are equal to the rating torques of the first and second servo motors 246, 256.

Step 5: the electrical control device controlling the first and second magnetic field generators 42, 43 to decrease magnetic field intensities when the output torques of the first and second servo motors 246, 256 are less than the corresponding rating torques of the first and second servo motors 246, 256, the first and second permanent magnetic counterweight blocks 44, 45 being subjected to a decreased downward magnetic force thereby increasing loading of the first and second servo motors 246, 256, the output torques of the first and second servo motors 246, 256 being increased with the increase of the loading until the output torques are equal to the rating torques of the first and second servo motors 246, 256.

In summary, the present invention provides a crane with an automatic counterweight balancing device and a method of arranging counterweight thereof, which uses a combined arrangement of magnetic field generators, permanent magnetic counterweight blocks, an electrical control device, and a transducer device to detect, in a real time manner, output torques of servo motors, whereby when the output torques are not equal to rating torques, magnetic field intensities are varied to change downward magnetic forces acting on the permanent magnetic counterweight blocks thereby regulating loading of the servo motors and thus regulating the output torques of the servo motors to effect automatic balancing of counterweight and improve stability of the crane during a conveyance process and also to effectively prevent overloaded operation of the servo motors, extend the operation lives of the servo motors, and lower down the costs.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A crane with an automatic counterweight balancing device, comprising a main body and a counterweight device mounted on the main body, the main body comprising first and second racks that are arranged opposite to each other, first and second transmission devices that are respectively mounted to the first and second racks, and a carriage platform connected between the first and second transmission devices, the counterweight device comprising first and second magnetic field generators respectively mounted to the first and second racks and first and second permanent magnetic counterweight blocks respectively mounted to the first and second transmission devices.

2. The crane with an automatic counterweight balancing device as claimed in claim 1, wherein the first transmission device comprises a first pulley, a first transmission belt that is provided in association with the first pulley, and a first servo motor that is in driving coupling with the first pulley, the second transmission device comprising a second pulley, a second transmission belt that is provided in association with the second pulley, and a second servo motor that is in driving coupling with the second pulley.

3. The crane with an automatic counterweight balancing device as claimed in claim 2, wherein the first permanent magnetic counterweight block is mounted to the first transmission belt, the second permanent magnetic counterweight block being mounted to the second transmission belt.

4. The crane with an automatic counterweight balancing device as claimed in claim 2, wherein the counterweight device comprises an electrical control device electrically connected to the first and second magnetic field generators, the electrical control device functioning to control magnetic field intensities of the first and second magnetic field generators.

5. The crane with an automatic counterweight balancing device as claimed in claim 4, wherein the counterweight device comprises a transducer device electrically connected to the electrical control device, the transducer device functioning to monitor output torques of the first and second servo motors and transmitting the detected output torques to the electrical control device.

6. The crane with an automatic counterweight balancing device as claimed in claim 1, wherein the permanent magnetic counterweight blocks comprise permanent magnets.

7. A crane with an automatic counterweight balancing device, comprising a main body and a counterweight device mounted on the main body, the main body comprising first and second racks that are arranged opposite to each other, first and second transmission devices that are respectively mounted to the first and second racks, and a carriage platform connected between the first and second transmission devices, the counterweight device comprising first and second magnetic field generators respectively mounted to the first and second racks and first and second permanent magnetic counterweight blocks respectively mounted to the first and second transmission devices;

wherein the first transmission device comprises a first pulley, a first transmission belt that is provided in association with the first pulley, and a first servo motor that is in driving coupling with the first pulley, the second transmission device comprising a second pulley, a second transmission belt that is provided in association with the second pulley, and a second servo motor that is in driving coupling with the second pulley;

wherein the first permanent magnetic counterweight block is mounted to the first transmission belt, the second permanent magnetic counterweight block being mounted to the second transmission belt;

wherein the counterweight device comprises an electrical control device electrically connected to the first and second magnetic field generators, the electrical control device functioning to control magnetic field intensities of the first and second magnetic field generators;

wherein the counterweight device comprises a transducer device electrically connected to the electrical control device, the transducer device functioning to monitor output torques of the first and second servo motors and transmitting the detected output torques to the electrical control device; and wherein the permanent magnetic counterweight blocks comprise permanent magnets.

8. A method of assembling a crane, comprising the following steps:

(1) providing a crane main body and a counterweight device, wherein the crane main body comprises first and second racks that are arranged opposite to each other, first and second transmission devices that are respectively mounted to the first and second racks, and a carriage platform connected between the first and second transmission devices, the first transmission device comprising a first pulley, a first transmission belt that is provided in association with the first pulley, and a first servo motor that is in driving coupling with the first pulley, the second transmission device comprising a second pulley, a second transmission belt that is provided in association with the second pulley, and a second servo motor that is in driving coupling with the second pulley, the counterweight device comprising first and second magnetic field generators, first and second permanent magnetic counterweight blocks, an electrical control device, and a transducer device;

(2) mounting the counterweight device to the crane main body, wherein the first magnetic field generators are mounted to two ends of the first rack, the first permanent magnetic counterweight block being mounted to the first transmission belt, the second magnetic field generators being mounted to two ends of the second rack, the second permanent magnetic counterweight block being mounted to the second transmission belt, the electrical control device being electrically connected to the first and second magnetic field generators, the transducer device being mounted to the first and second servo motors and electrically connected to the electrical control device;

(3) the transducer device monitoring, in a real time manner, output torques of the first and second servo motors and transmitting the detected output torques to the electrical control device, the electrical control device comparing the output torques of the first and second servo motors with rating torques of the first and second servo motors that are previously loaded in the electrical control device;

(4) the electrical control device controlling the first and second magnetic field generators to increase magnetic field intensities when the output torques of the first and second servo motors are greater than corresponding rating torques of the first and second servo motors, the first and second permanent magnetic counterweight blocks being subjected to an increased downward magnetic force thereby decreasing loading of the first and second servo motors, the output torques of the first and second servo motors being decreased with the decrease of the loading until the output torques are equal to the rating torques of the first and second servo motors; and (5) the electrical control device controlling the first and second magnetic field generators to decrease magnetic field intensities when the output torques of the first and second servo motors are less than the corresponding rating torques of the first and second servo motors, the first and second permanent magnetic counterweight blocks being subjected to a decreased downward magnetic force thereby increasing loading of the first and second servo motors, the output torques of the first and second servo motors being increased with the increase of the loading until the output torques are equal to the rating torques of the first and second servo motors.

9. The method of assembling a crane as claimed in claim 8, wherein the permanent magnetic counterweight blocks comprise permanent magnets.

* * * * *